United States Patent [19]

Cox et al.

[11] 4,265,409

[45] May 5, 1981

[54] WEB REWINDER TURRET SWING CONTROL

[75] Inventors: Jon N. Cox, Oakland, Me.; Balbir Singh, Media, Pa.

[73] Assignee: Scott Paper Company, Philadelphia, Pa.

[21] Appl. No.: 93,529

[22] Filed: Nov. 13, 1979

[51] Int. Cl.[3] ..... B65H 19/20

[52] U.S. Cl. ..... 242/56 A

[58] Field of Search ..... 242/56 R, 56 A, 64

[56] References Cited

U.S. PATENT DOCUMENTS

| | | | |
|---|---|---|---|
| Re. 28,353 | 3/1975 | Nystrand | 242/56 A |
| 2,736,508 | 2/1956 | Langbo | 242/56 A |
| 2,769,600 | 11/1956 | Kwitek | 242/64 X |
| 3,116,890 | 1/1964 | Nystrand | 242/64 |
| 3,179,348 | 4/1965 | Nystrand | 242/56 R |

*Primary Examiner*—Edward J. McCarthy

*Attorney, Agent, or Firm*—Joseph H. Yamaoka; William J. Foley

[57] ABSTRACT

An apparatus that controls the swinging of a frame (50) and the rotation of a turret (52) in an automatic web rewinding machine. The frame (50) is pivotally mounted in the machine and a turret (52) including a plurality of rotatable mandrel assemblies (56) is mounted for rotation within the frame (50). The control apparatus includes an indexing device (66) having an output shaft (70) that undergoes intermittent rotation in response to continuous rotation of an input shaft (68). One drive means (80), coupled and responsive to the output shaft (70) of the indexing device (66) provides intermittent rotation of the turret (52). A second drive means (78) is provided to control the rotation of the cam (60) in order to minimize the overlap of the rotation of the cam (60) with the dwell time of the turret (52). The optimum condition occurs when the cam (60) rotates only when the turret (52) is indexing and when the cam (60) does not rotate at all while the turret (52) is dwelling. This optimum condition is achieved by having the second drive means (78) also coupled and responsive to the output shaft (70) of the indexing device (66) for providing the intermittent rotation of cam (60) in synchronism with the rotation of the turret (52).

17 Claims, 5 Drawing Figures

WEB REWINDER TURRET SWING CONTROL

TECHNICAL FIELD

This invention is generally related to automatic web rewinding machines wherein a web from a large roll, known in the art as a parent roll, is automatically wound onto cores to form smaller rolls having a diameter and length that is suitable for use by a consumer. More particularly, this invention is related to automatic web rewinding machines that have a rotating turret mounted on a swinging frame. This invention is specifically directed to an apparatus for simultaneously controlling the swinging of the frame and the rotation of the turret.

BACKGROUND ART

The Series 100 and 150 continuous winders manufactured by Paper Converting Machine Company and as described in U.S. Pat. Nos. 2,769,600—Kwitek et al and 3,179,348—Nystrand et al are representative of the prior art. Those automatic web rewinding machines have a turret mounted for rotation within a frame which is pivotally mounted in the machine. The turret includes six rotatable mandrel assemblies. The web being rewound from a parent roll passes over a bedroll of the machine and is wound about a core placed on a mandrel assembly located at a winding station adjacent to the bedroll. A fresh core, with glue applied to the core, is mounted on the mandrel assembly that will next approach the winding station. As the winding of the roll at the winding station nears completion, the turret begins to index, or rotate, and the frame is caused to swing toward the bedroll so that the fresh core is brought into close proximity to the bedroll. The web is then severed and the free end of the web from the parent roll is caused to be transferred to the glue on the fresh core to begin the winding of a roll on the fresh core. Immediately after transfer, the turret swings away from the bedroll so that the roll being wound does not contact the bedroll. Before the turret finishes indexing it is necessary to swing the turret to a dwell position at which the next fresh core which has glue freshly applied to it; will not prematurely contact the web during the winding process. After the turret has completed indexing, or rotating 60 degrees, it dwells in that position for a considerable period of time during which a completely wound roll can be stripped from a mandrel assembly located adjacent to a stripping station and a fresh core can be placed onto a mandrel assembly that is located adjacent to a supply of cores.

In the prior art machines, the swing of the frame and turret assembly is controlled by a cam mounted for rotation on the frame which cooperates with a roller assembly mounted in the machine. As the cam rotates, the periphery of the cam controls the angle of rotation of the frame and, therefore, the location of the freshly glued core with respect to the web being wound and the bedroll. In the prior art machines, an internal Geneva mechanism is used to control the indexing of the turret. The internal Geneva mechanism has an input shaft and an output shaft, and for one continuous revolution of the input shaft, the output shaft dwells 33 percent of the time and causes the turret to rotate through 1.05 radians during the remainder of the time. In the prior art machines, the cam is geared to the input shaft to the internal Geneva mechanism so that it makes one continuous revolution for each indexing cycle of the turret. Since it is only desired to swing the turret while it is indexing, 33 percent of the cam surface is not available to control the swinging of the turret.

Attempts have been made to increase the productivity of the prior art automatic web rewinding machines by running them at a higher cycle rate. When operated at these higher cycle rates, it has been found that the reduced dwell time of the turret is insufficient to reliably strip a completely wound core from the mandrel assembly, or to place a fresh core onto a mandrel assembly. Another problem that is encountered at the higher cycle rate is increased vibration and backlash of the turret which sometimes causes poor transfers of the web to the fresh core or tearing of the web during the winding of the roll. This increased vibration and backlash is caused by high pressure angles at the point of contact of the cam periphery and the roller. It was believed that a more effective transfer of the web to the fresh core would take place if the transfer occurred "higher up on the bedroll", which occurs by swinging the turret further toward the bedroll at transfer so that the vertical distance between the axis of the mandrel that is approaching the winding station and the axis of the bedroll is increased over that of the prior art machines. Normally this would be accomplished by shaping the cam so that the frame and turret assembly undergo the desired additional motion toward the bedroll. However, when it was attempted to design a cam to provide this additional rotation of the frame and turret assembly, it was found that the cam could not be physically realized because such a cam would be "under cut".

Another prior art automatic web rewinding machine is the series 200 continuous winder manufactured by Paper Converting Machine Company. In this machine, the intermittently rotating turret is mounted in a stationary frame. As in the case of the series 100 and 150 rewinding machines, during the indexing of the turret, it is necessary to prevent the fresh core with the glue applied thereto from coming in contact with the web that is being wound. This is accomplished by means of a moving deflector bar, driven in synchronism with the turret, which causes the web to be deflected toward and in close proximity to the bedroll which keeps the web out of the path of the freshly glued core. Although the series 200 automatic web rewinding machine, which operates at a higher cycle rate than the series 100 and 150 machines is commercially available, the increase in productivity does not justify the purchase of a new machine to replace the swinging turret model. It is also not economically feasible to modify the swinging turret machines to have a fixed turret frame and to incorporate a web deflector bar.

DISCLOSURE OF INVENTION

In accordance with this invention, the apparatus that controls the swinging of the frame and the rotation of the turret in an automatic web rewinding machine includes an indexing device having an output shaft that undergoes intermittent rotation in response to continuous rotation of an input shaft. One drive means, coupled and responsive to the output shaft of the indexing device, provides intermittent rotation of the turret. Since it is only desired to swing the frame and turret assembly when the turret is indexing, a second drive means is provided to control the rotation of the cam in order to minimize the overlap of the rotation of the cam with the dwell time of the turret. The optimum condition occurs when the cam rotates only when the turret is indexing and when the cam does not rotate at all while the turret is dwelling. Under this optimum condition of turret swing control, the entire periphery of the cam is available to control the swinging of the frame. This optimum condition is achieved by having the second drive means also coupled and responsive to the output shaft of the indexing device for providing the intermittent rotation of the cam in synchronism with the rotation of the turret.

The time available during the dwell time of the turret at higher cycle rates is increased by replacing the internal Geneva mechanism used in the prior art machine, which has a dwell-to-index ratio of 1 to 2, by an indexing device that has a dwell-to-index ratio of 1 to 1. The combined factors of changing the dwell-to-index ratio, rotating the cam only when the turret is indexing and operating at a higher cycle rate all result in the critical portion of the swinging of the frame taking place over about 1.22 radians of rotation of the cam as compared to about 0.523 radians of rotation of the cam for the prior art machines. As a result, the pressure angles of the roller and cam arrangement are reduced considerably and the operation of the automatic web rewinding machine is considerably smoother, particularly during transfer of the web to a fresh core, even though it is operating at a higher cycle rate.

BRIEF DESCRIPTION OF DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

BEST MODE FOR CARRYING OUT THE INVENTION

Figure 1:
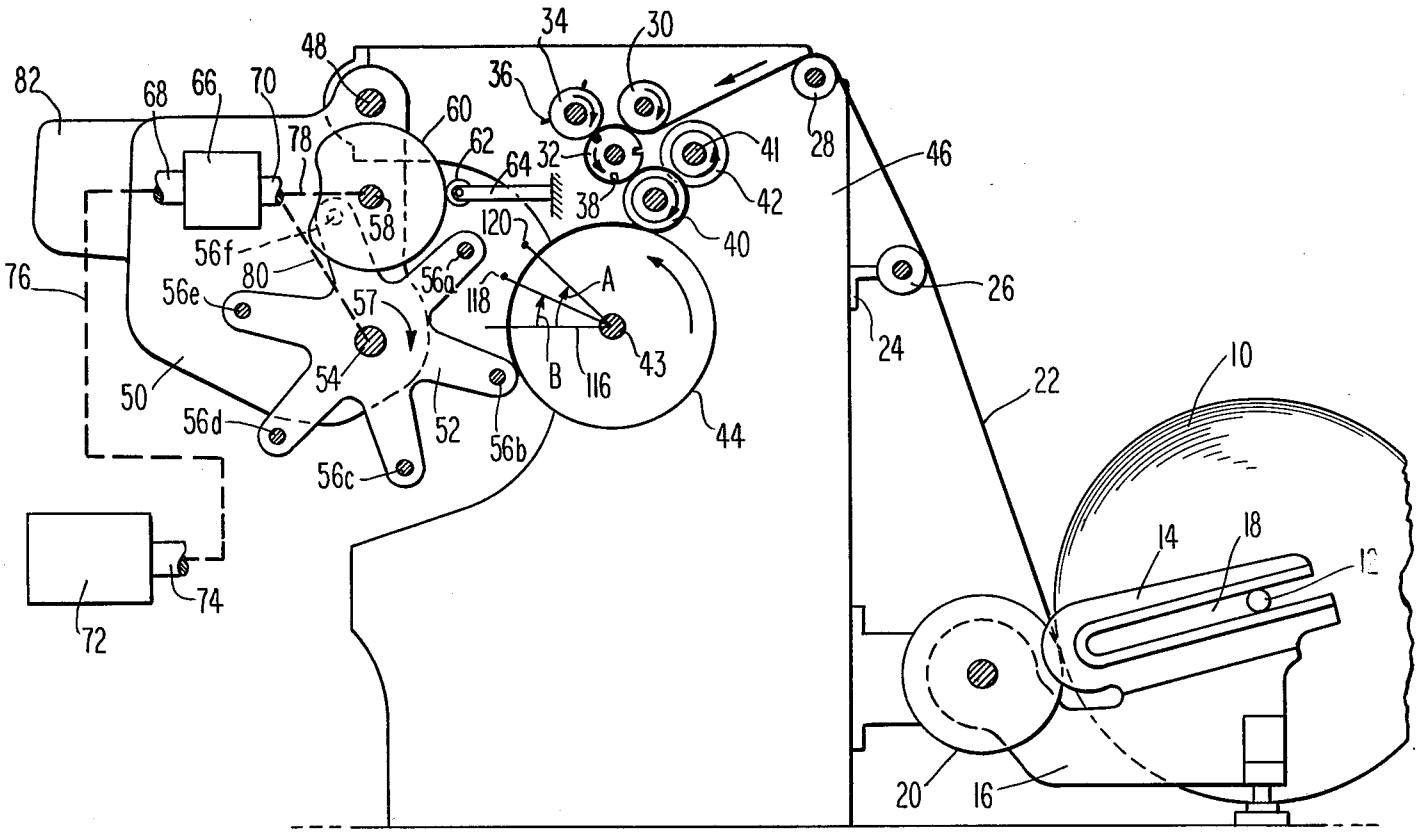
FIG. 1 is a side elevation, partially in block diagram form, of portions of the automatic web rewinding machine including the turret swing control apparatus.

For the sake of convenience, an element depicted in more than one figure will retain the same element number in each figure. FIG. 1 shows the turret swing control apparatus of this invention and those portions of an automatic web rewinding machine necessary or helpful in disclosing the invention. A more detailed description of an automatic web rewinding machine having a swinging turret which can be controlled in accordance with this invention can be found in U.S. Pat. No. 2,769,600, issued to E. M. Kwitek et al, which is hereby incorporated by reference into this application. Referring now to FIG. 1, there is shown a parent roll 10 of a web material such as paper tissue. A shaft 12 extends through the parent roll 10. Each end of shaft 12 is supported by an elongated slot 18 formed within a pair of spaced-apart brackets 14. The brackets 14 are supported on a base or floor by a suitable supporting structure 16 which rests on the machine base and which can also be secured to the main frame 46 of the machine. Slots 18 slope downward toward the machine so that the gravitational force acting on the parent roll 10 causes it to move downwardly in the slots 18 until the periphery of the parent roll 10 contacts a delivery roller 20. The delivery roller 20 is journalled upon suitable bearings in the supporting structure 16 and is driven so that upon frictional engagement with the parent roll 10, a web 22 is delivered from the parent roll 10 to the winding machine. The web 22 is delivered upwardly over an idler roller 26 which is rotatably mounted in a bracket 24 secured to main frame 46 of the machine. The web 22 then travels over another idler roller 28 mounted in the rewinding machine, through a nip formed by a driven feed roll 30 and a secondary perforator roll 32, and then through a nip formed by the secondary perforator roll 32 and a primary perforator roll 34. The primary perforator roll 34 is equipped with a plurality of spaced perforating knives 36 that coact with recesses 38 in the secondary perforator roll 32 to provide spaced apart transverse perforations of the web 22. The web 22 then travels between a nip formed by the secondary perforator roll 32 and a secondary slitting roll 40 where the web 22 is slit longitudinally into predetermined widths by the coaction of the secondary slitting roll 40 with slitting knives 42 carried on a shaft 41. After the web 22 has been slit, it passes through a nip formed by the secondary slitting roll 40 and a bedroll 44 which is secured to a shaft 43. The web 22 is then carried over the bedroll 44 and is wound upon cores (not shown) which are mounted on rotatable mandrel assemblies **56*a* through 56*f* mounted in a turret 52. The turret assembly 52 is keyed to a turret shaft 54 which is rotatably mounted in a frame member 50 and, as shown in the figure, the six mandrel assemblies 56*a* through 56*f* are equiangularly spaced about the turret shaft 54. As shown in FIG. 1, mandrel assembly 56*b* is in the vicinity of the winding station where web 22 is wound onto a core placed on mandrel assembly 56*b*; mandrel assembly 56*c* is adjacent to a stripping station where a completed roll is removed from mandrel assembly 56*c*; and mandrel assembly 56*d* is adjacent to a core receiving station where a fresh core is placed onto mandrel assembly 56*d*. As the turret 52 rotates clockwise, as indicated by arrow 57, to bring a fresh core to the position of mandrel assembly 56*a*, glue is applied to the surface of that core. In order to facilitate the transfer of the web 22 to the glued core on mandrel assembly 56*a*, the frame 50 in which the turret 52 is mounted can rotate about a pivot shaft 48. Secured to the frame 50 is a counterweight 82 which tends to rotate the frame 50 toward the bedroll 44. Cam 60, which is keyed to a shaft 58 that is rotatably mounted within the frame 50, cooperates with roller member 62 mounted in bracket 64 in the machine to control the desired position of frame 50 with respect to bedroll 44. As cam 60 is caused to rotate, the shape of the cam 60 controls the position of mandrel assemblies 56*a* and 56*b* with respect to the bedroll 44**.

Figure 2:
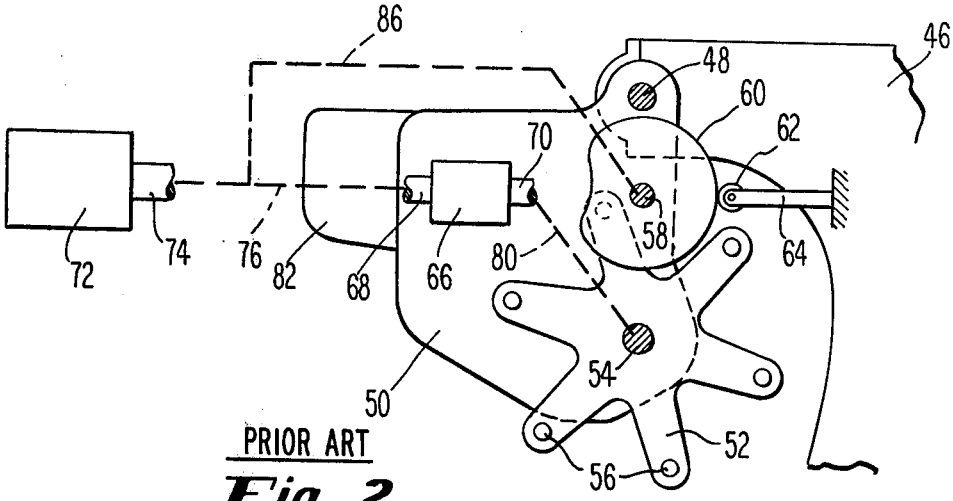
PRIOR ART Fig. 2
FIG. 2 is a side view, partially in block diagram form, of a prior art turret swing control apparatus.

One approach for controlling the rotations of turret 52 and cam 60 is shown in FIG. 2 and is described in detail in the aforementioned patent to Kwitek et al. The primary drive means as indicated by block 72 provides a continuously rotating shaft 74 output. Drive means 76, indicated schematically as a dashed line, connects output shaft 74 with an input shaft 68 of an internal Geneva mechanism 66. The input shaft 68 continuously rotates at a rate of one revolution per winding cycle of the machine. For each revolution of input shaft 68, an output shaft 70 of the internal Geneva mechanism 66 remains stationary for one-third of a cycle and rotates 60 degrees during the remaining two-thirds of the cycle. Although the turret shaft 54 is depicted as being driven from the output shaft 70 by drive means 80, indicated schematically by a dashed line, and the shaft 58 to which cam 60 is fastened is shown as being driven from continuously rotating output shaft 74 by drive means 86, also represented schematically by a dashed line, as described in the patent to Kwitek et al, the cam 60 is geared to the input shaft 68 of the internal Geneva mechanism 66 and the turret 52 is keyed to the output shaft 70 of internal Geneva mechamism 66. When driven in this manner, the cam 60 continuously rotates both during the dwell time of the turret 52 and during the indexing of the turret 52. Since it is not desired to swing the frame 50 and turret 52 while the turret 52 is dwelling, thirty-three percent of the periphery of the cam 60 is of a constant radius and is unavailable to control the swinging of the frame 50 and turret 52.

Referring now to FIG. 1, the apparatus for controlling the rotation of cam 60 and turret 52 in accordance with the invention will now be described. An indexing device 66 is shown mounted on the frame 50. The indexer 66 has an input shaft 68 which is driven from the continuously rotating shaft 74 of the primary drive 72 by drive means 76 shown schematically as a dashed line. The input shaft 68 of the indexer 66 is continuously driven through one revolution for each cycle of the machine. In one preferred embodiment of the invention, the output shaft 70 of the indexer 66 remains stationary for one-half of a cycle and undergoes 62.8 radians of rotation during the second half of the cycle. Drive means 80, shown schematically as a dashed line, is responsive to the rotation of output shaft 70 and causes the turret shaft 54 to rotate 1.05 radians during each machine cycle. Drive means 78, indicated schematically as a dashed line, is also responsive to the rotation of output shaft 70 and causes shaft 58, to which cam 60 is fastened, to rotate 6.28 radians while the output shaft 70 is rotating and causes the shaft 58 to be stationary when the output shaft 70 is stationary.

Figure 3:
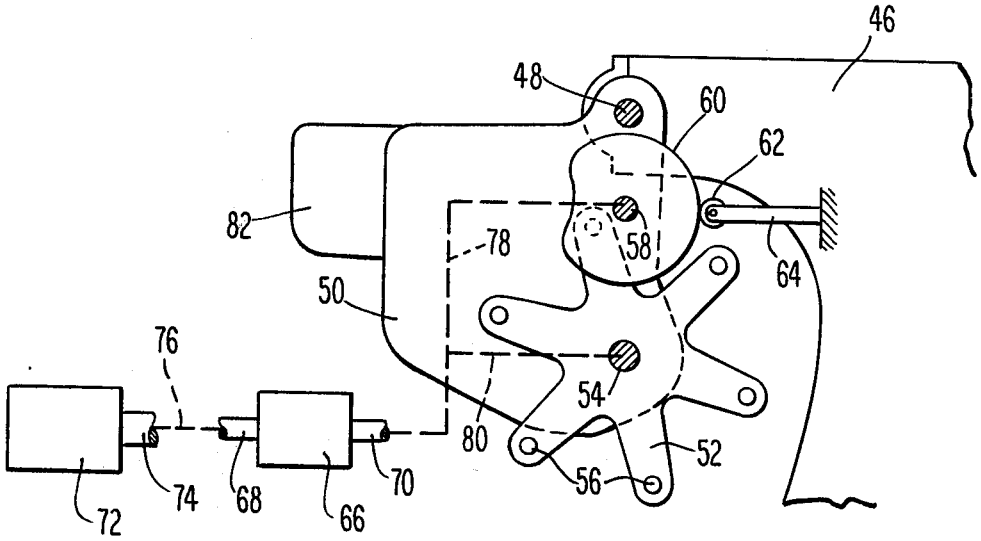
FIG. 3 is a side view, partially in block diagram form, of another embodiment of a turret swing control apparatus in accordance with this invention.

FIG. 3 illustrates substantially the same arrangement for controlling the rotation of turret shaft 54 and cam shaft 58 as depicted in FIG. 1 except that the indexer 66 is not mounted on the frame 50.

The optimum control of the rotation of cam 60 occurs when the cam 60 is stationary when the turret 52 is stationary, and begins to rotate precisely when the turret 52 begins to index and completes one complete revolution precisely when the turret 52 stops rotating, because under these conditions, the entire periphery of the cam 60 is available to control the swinging motion of the frame 50 and turret 52. This optimized swing control can be achieved with the cam and turret control means illustrated in FIG. 1, 3, 4, or 5.

Figure 4:
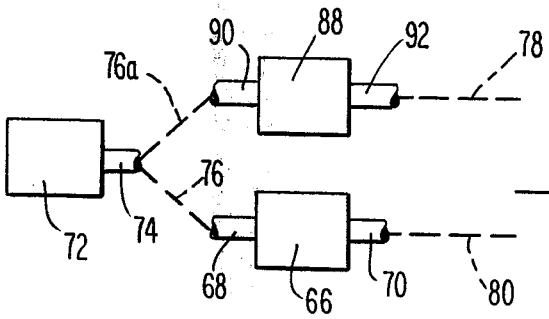
FIG. 4 is a block diagram showing independent index means for controlling the cam.

The cam drive arrangement in FIG. 4 illustrates another embodiment of the invention which can be used if it is not desired to have the rotation of the cam 60 be in precise synchronism with the rotation of the turret 52. A first indexing device 66 controls the rotation of the turret shaft 54 and a second indexing device 88 controls the rotation of cam shaft 58. Drive means **76*a*, indicated schematically as a dashed line, responds to the continuous rotation of shaft 74 and provides continuous rotation of input shaft 90 of index means 88. Drive means 78, indicated schematically as a dashed line, responds to the intermittent rotation of output shaft 92 and provides for intermittent rotation of cam shaft 58**.

Figure 5:
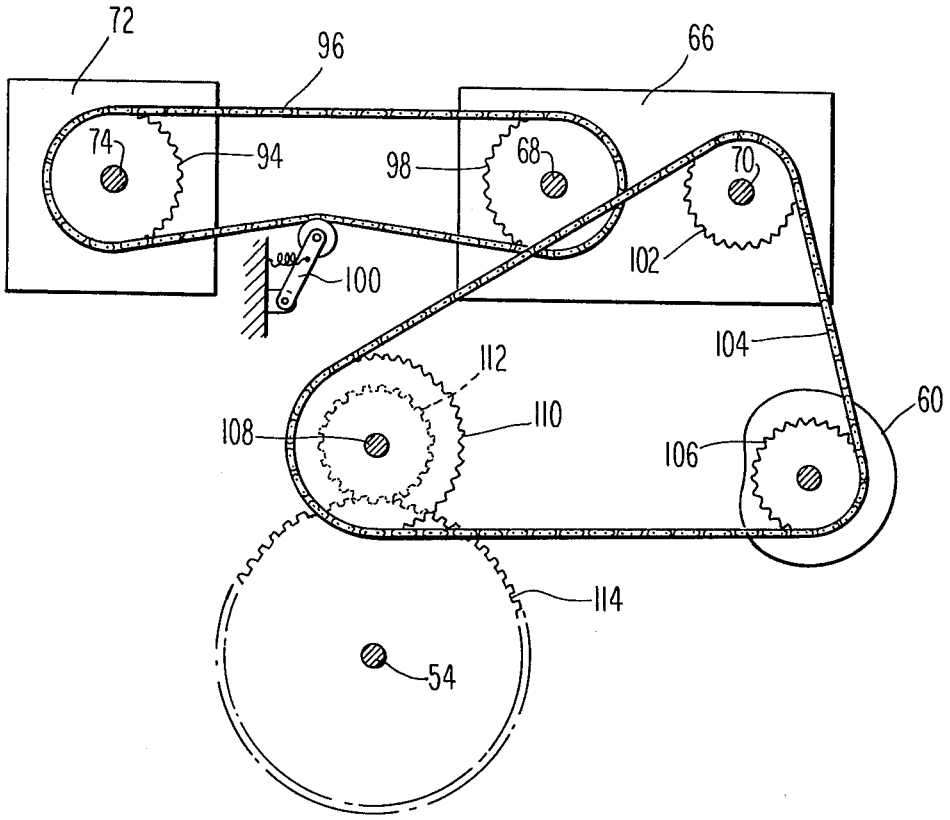
FIG. 5 is a diagram showing particular means for driving the turret and the cam.

Referring now to FIG. 5, there is depicted a preferred embodiment for driving the input shaft 68 of the indexer 66 and for driving the cam shaft 58 and the turret shaft 54 from the output shaft 70 of indexer 66. The indexer 66 is a Cyclo-Index mechanism, Model 180-1-2800, which is available from the Hilliard Corporation, 100 West 4th Street, Elmira, N.Y. 14902. The indexer 66 is mounted on the frame 50 as shown in FIG. 1. A sprocket 94 is secured to the continuously rotating shaft 74 of the drive means 72. A sprocket 98 is secured to the input shaft 68 of the indexer 66. The drive for sprocket 98 is obtained from sprocket 94 by means of a chain 96. The tensioning member 100 compensates for the changing distance between the axis of shaft 74 and the axis of shaft 68 that occurs when the indexer 66 is mounted on the swinging frame 50. The drive means 72, continuously rotating shaft 74, sprocket 94, chain 96 and sprocket 98 together comprise means for continuously rotating the shaft 68 of the indexer 66. A sprocket 102 having 21 teeth is fastened to the output shaft 70 of the indexer 66. A similar sprocket 106 also having 21 teeth is secured to the cam shaft 58. A sprocket 110 having 42 teeth is fastened to a counter shaft 108. Also secured to the counter shaft 108 is a gear 112 having 26 teeth. Gear 112 meshes with gear 114 which has 78 teeth and which is fastened to the turret shaft 54. The drive for both sprockets 106 and 110 is obtained from the output shaft 70 by means of chain 104. Since sprockets 102 and 106 both have the same number of teeth, one complete revolution of output shaft 70 will result in one complete revolution of cam shaft 58. Sprocket 102, chain 104 and sprocket 106 together comprise drive means responsive to the output shaft 70 of the indexer 66 for providing intermittent rotation of the cam 60. Since sprocket 110 has twice as many teeth as sprocket 102, one revolution of output shaft 70 will result in 3.14 radians of rotation of counter shaft 108 and since gear 114 has three times as many teeth as gear 112, 180 degrees of rotation of counter shaft 108 results in 1.05 radians of rotation of turret shaft 54. Thus, it can be seen that for one complete revolution of the output shaft 70 of the indexer 66, the cam 60, which is secured to cam shaft 58, will undergo one complete revolution as the turret is indexed through 1.05 radians of rotation. Sprocket 102, chain 104, sprocket 110, gear 112, and gear 114 together comprise drive means responsive to the output shaft 70 of the indexer 66 for providing intermittent rotation of the turret 52. When the cam 60 and the turret 52 are controlled in this manner, the entire periphery of the cam 60 is available to control the swinging of the frame 50 and the turret 52. This represents a 50 percent increase over the prior art in the amount of the periphery of cam 60 to control the swinging of frame 50 and turret 52. As a result, the pressure angles between cam 60 and roller 62 are significantly reduced, and, furthermore, in contrast to the prior art machines, it is possible to physically realize a cam 60 that will allow transfer to occur higher up on the bedroll. This is illustrated in FIG. 1 which shows a typical point 118 representing the location of the periphery of a fresh core at transfer for the prior art machines and a point 120 representing the location of the periphery of a fresh core at transfer that is "higher up on the bedroll" in accordance with this invention. Using as a reference a horizontal line 116 passing through the axis of the bedroll shaft 43, the point 118 is typically about 0.004–0.007 meters from the surface of the bedroll 44 and makes an angle, A, of about 0.262 radians with horizontal line 116. It was not possible to physically realize a cam to provide an angle, A, much greater than 0.262 radians. The point 120 representing the location of the periphery of a fresh core at transfer in accordance with this invention is about 0.004–0.007 meters from the surface of the bedroll 44 and makes an angle, B, of about 0.384 radians with the horizontal line 116 which allows more efficient transfer of the web to a fresh core.

While the present invention has been described with reference to a specific embodiment thereof, it will be obvious to those skilled in the art that various changes and modifications may be made without departing from the invention in its broader aspects. For example, since the index means 66 is a device that converts continuous shaft rotation into intermittent shaft rotation, a timed clutch can be utilized to accomplish the function.

What is claimed is:

1. An improved automatic web rewinding machine having a pivotally mounted frame, a turret mounted for rotation within the frame, said turret including a plurality of rotatable mandrel assemblies, means including a rotating cam for controlling the angular position of the frame, and index means for intermittently rotating the turret wherein the improvement comprises means for intermittently rotating the cam so that a major portion of the cam rotation coincides with the rotation of the turret.

2. An improved web rewinding machine as recited in claim 1 wherein the means for controlling the angular position of the frame comprises a rotating cam mounted on the frame and a roller fixedly mounted in the rewinding machine.

3. An improved web rewinding machine as recited in claim 1 wherein the means for intermittently rotating the cam is a timed clutch.

4. An improved web rewinding machine as recited in claim 1, wherein the means for intermittently rotating the cam is an indexer.

5. An improved web rewinding machine as recited in claim 1 wherein the cam is stationary when the turret is stationary and the cam makes one complete revolution as the turret indexes whereby the entire periphery of the cam is available to control the swinging of the frame while the turret is indexing.

6. An improved web rewinding machine as recited in claim 1 wherein the index means is mounted on the frame.

7. An improved web rewinding machine as recited in claim 2 wherein the cam is stationary when the turret is stationary and the cam makes one complete revolution as the turret indexes whereby the entire periphery of the cam is available to control the swinging of the frame while the turret is indexing.

8. An improved web rewinding machine as recited in claim 7 wherein the index means is mounted on the frame.

9. An improved automatic web rewinding machine having a bedroll, a pivotally mounted frame, a turret mounted for rotation within the frame, said turret including a plurality of rotatable mandrel assemblies, a cam mounted for rotation within the frame, a roller mounted in the rewinding machine and coacting with the cam to control the position of a mandrel with respect to the bedroll, wherein the improvement comprises:

(a) an index means having an output shaft that undergoes intermittent rotation in response to continuous rotation of an input shaft of the index means;

(b) first drive means for continuously rotating the input shaft of the index means;

(c) second drive means, responsive to the output shaft of the index means, for providing intermittent rotation of the turret; and (d) third drive means, also responsive to the output shaft of the index means, for providing intermittent rotation of the cam thereby controlling the swinging of the frame.

10. An improved automatic web rewinding machine as recited in claim 9 wherein the index means is a timed clutch.

11. An improved web rewinding machine as recited in claim 9 wherein the cam is stationary when the turret is stationary and the cam makes one complete revolution as the turret indexes whereby the entire periphery of the cam is available to control the swinging of the frame while the turret is indexing.

12. In an automatic web rewinding machine having a pivotally mounted frame, a turret mounted for rotation within the frame, said turret including a plurality of rotatable mandrel assemblies, and means, including a rotating cam for controlling the angular position of the frame, an improved apparatus for controlling the rotation of the turret and the swinging of the frame comprising:

(a) an index means having an output shaft that undergoes intermittent rotation in response to continuous rotation of an input shaft of the index means;

(b) first drive means for continuously rotating the input shaft of the index means;

(c) second drive means, responsive to the output shaft of the index means, for providing intermittent rotation of the turret; and (d) third drive means, also responsive to the output shaft of the index means, for providing intermittent rotation of the cam thereby controlling the swinging of the frame.

13. An apparatus as recited in claim 12 wherein the index means is a timed clutch.

14. An apparatus as recited in claim 12 wherein the cam is stationary when the turret is stationary and the cam makes one complete revolution as the turret indexes whereby the entire periphery of the cam is available to control the swinging of the frame while the turret is indexing.

15. In an automatic web rewinding machine having a pivotally mounted frame, a turret mounted for rotation within the frame, said turret including a plurality of rotatable mandrel assemblies, and means including a rotating cam for controlling the angular position of the frame, an improved apparatus for controlling the rotation of the turret and the swinging of the frame comprising:

(a) an index means having an output shaft that undergoes intermittent rotation in response to continuous rotation of an input shaft of the index means;

(b) first drive means for continuously rotating the input shaft of the index means;

(c) second drive means, responsive to the output shaft of the index means, for providing intermittent rotation of the turret;

(d) a second index means having an input shaft continuously driven by the first drive means and having an output shaft that undergoes intermittent rotation; and (e) third drive means responsive to the output shaft of the second index means for providing intermittent rotation of the cam thereby controlling the swinging of the frame.

16. An improved apparatus as recited in claim 15 wherein the second index means is a timed clutch.

17. An apparatus as recited in claim 15 wherein the cam is stationary when the turret is stationary and the cam makes one complete revolution as the turret indexes whereby the entire periphery of the cam is available for control the rotation of the frame while the turret is indexing.

* * * * *